US010799726B2

(12) United States Patent
Graziani et al.

(10) Patent No.: US 10,799,726 B2
(45) Date of Patent: Oct. 13, 2020

(54) FULL HOOD RESPIRATOR

(71) Applicant: L'Air Liquide, Societe Anonyme pour I'Etude et I'Exploitation des Procedes Georges Claude, Paris (FR)

(72) Inventors: Vincent Graziani, Chabons (FR); Christian Rolland, Vif (FR); Rachid Makhlouche, Grenoble (FR)

(73) Assignee: L'Air Liquide Societe Anonyme Pour L'Etude Et L'Expoitation Des Procedes Georges Claude, Paris (FR)

( * ) Notice: Subject to any disclaimer, the term of this patent is extended or adjusted under 35 U.S.C. 154(b) by 784 days.

(21) Appl. No.: 14/814,900

(22) Filed: Jul. 31, 2015

(65) Prior Publication Data

US 2016/0030774 A1 Feb. 4, 2016

(30) Foreign Application Priority Data

Aug. 1, 2014 (FR) ..... 14 57491

(51) Int. Cl.
*A62B 7/14* (2006.01)
*A62B 18/04* (2006.01)
*A62B 17/04* (2006.01)

(52) U.S. Cl.
CPC ..... *A62B 7/14* (2013.01); *A62B 17/04* (2013.01); *A62B 18/04* (2013.01)

(58) Field of Classification Search
CPC ..... A62B 18/04; A62B 7/14; A62B 17/04; A62B 17/01; A41D 13/00; A41D 13/001; A61F 9/06
See application file for complete search history.

(56) References Cited

U.S. PATENT DOCUMENTS 2,296,338 A 9/1942 Dakin
4,552,140 A 11/1985 Cowley et al.
(Continued)

FOREIGN PATENT DOCUMENTS

CN 2 621 744 6/2004
CN 2012 39 446 5/2009
(Continued)

OTHER PUBLICATIONS

Rolland, et al., "Full Hood Respirator," U.S. Appl. No. 14/814,886, filed Jul. 31, 2015.
(Continued)

*Primary Examiner* — Timothy A Stanis
*Assistant Examiner* — Cana A Gallegos
(74) *Attorney, Agent, or Firm* — Christopher J. Cronin

(57) ABSTRACT

A full hood respirator includes a fluidtight flexible bag intended to be slipped over the head of a user, the flexible bag being equipped with a transparent window and comprising, in its lower part, a source of oxygen-enriched gas and connected to an outlet orifice opening into the internal volume of the flexible bag, characterized in that the hood comprises a flexible suspension member arranged inside the flexible bag, the suspension member forming a hat or cap having a surface area smaller than the surface area of the outer flexible bag, at least part of the border of the suspension member is rigidly connected to the flexible bag, the suspension member being intended, when the hood is in the position of use, to rest on the top of the head of the user at a height somewhere between the base and the top of the hood.

3 Claims, 2 Drawing Sheets

(56) References Cited

U.S. PATENT DOCUMENTS

| | | | | | |
|---|---|---|---|---|---|
| 4,896,665 | A * | 1/1990 | Gervais | A62B 17/04 | 128/201.22 |
| 5,526,804 | A * | 6/1996 | Ottestad | A62B 7/02 | 128/201.22 |
| 6,367,085 | B1 * | 4/2002 | Berg | A42B 3/145 | 128/201.24 |
| 2003/0075174 | A1 * | 4/2003 | Shahaf | A61M 16/06 | 128/201.25 |
| 2008/0236195 | A1 | 10/2008 | Woebke | | |

FOREIGN PATENT DOCUMENTS

| | | | | |
|---|---|---|---|---|
| EP | 1 793 147 | | 6/2007 | |
| WO | WO 2012/156727 | | 11/2012 | |
| WO | WO 2014/031671 | | 2/2014 | |
| WO | WO 2014031671 | A1 * | 2/2014 | A62B 7/10 |
| WO | WO-2014031671 | A1 * | 2/2014 | A62B 7/10 |

OTHER PUBLICATIONS

French Search Report and Written Opinion for FR 1457491, dated Mar. 18, 2015.
French Search Report and Written Opinion for FR 1 457 490, dated Mar. 18, 2015.

* cited by examiner

FULL HOOD RESPIRATOR

CROSS-REFERENCE TO RELATED APPLICATIONS

This application claims the benefit of priority under 35 U.S.C. § 119 (a) and (b) to French patent application No. 1457491, filed Aug. 1, 2014, the entire contents of which are incorporated herein by reference.

BACKGROUND

Field of the Invention

The present invention relates to respiratory equipment. The invention relates more particularly to a full-hood respirator, notably for an aircraft.

Related Art

Full hood respirators are conventionally used onboard aeroplanes when the cabin atmosphere is vitiated (depressurised, smoke, chemical agents, etc).

This equipment must also notably allow the flight crew to tackle the problem, provide emergency assistance to the passengers and manage a potential evacuation of the aircraft.

The technical specifications for such devices are defined according to class of use (in-flight damage, protection against high-altitude hypoxia, emergency evacuation on the ground, etc).

Known respiratory equipment chiefly employs two types of oxygen source:

- a chemical brick (also referred to as a "chemical oxygen generator") that generates oxygen by combustion (potassium superoxide—$KO_2$, sodium chlorate—$NaClO_3$, etc), or
- a compressed-oxygen reservoir associated with a calibrated orifice.

Hoods using the second type (pressurized oxygen reservoir associated with a calibrated orifice) thus generally contain a source of oxygen that allows an individual to be supplied with oxygen for fifteen minutes at a determined gas flow rate profile. This equipment may also in certain cases have a means of limiting the pressure inside the hood (for example an overpressure relief valve).

This technology using compressed oxygen in a sealed container associated with a calibrated orifice is safer. Nevertheless, certain users may have problems keeping the hood in place, particularly in stressful situations.

Known respiratory equipment generally uses either a fully transparent outer bag or systems that include buckles, straps or elastics for adjustment and holding in place.

Even if the transparent outer bags do not follow the rotations of the head, the user can nevertheless still see out. These transparent bags (of the Kapton® type) are, however, generally less fire resistant than opaque bags (of the coated Nomex® type). In addition, the ergonomics of these solutions is mediocre because the transparent bag "floats" on the user's head.

In the other known solution, buckles, straps or elastics are provided around the face and possibly the torso or bust of the user. In that case, the visor or viewing window follows the movements of the user's head but the straps and buckles take time to fit. Aside from the effort and loss of time spent fitting, this solution exhibits risks of oversight and incorrect adjustment. Ultimately, there is the risk that the device may not follow the movements of the head and/or the risk that it may hamper the user. It is an object of the present invention to alleviate all or some of the abovementioned disadvantages of the prior art.

SUMMARY OF THE INVENTION

To this end, the invention is directed to a hood comprising a fluidtight flexible bag intended to be slipped over the head of a user, the flexible bag being equipped with a transparent window and comprising, in its lower part, a source of oxygen-enriched gas and connected to an outlet orifice opening into the internal volume of the flexible bag. The hood further comprises a flexible suspension member arranged inside the flexible bag, the suspension member forming a hat or cap having a surface area smaller than the surface area of the outer flexible bag. At least part of the border of the suspension member is rigidly connected to the flexible bag. The suspension member is adapted and configured, when the hood is in the position of use, to rest on the top of the head of the user at a height somewhere between the base and the top of the hood. Moreover, some embodiments of the invention may comprise one or more of the following features:

- at least part of the border of the suspension member is rigidly connected to the flexible bag at a height somewhere between the base and the top of the hood,
- the suspension member is for example rigidly and/or semi-rigidly and/or flexibly connected to the flexible bag (for example via a textile, one or more straps, etc),
- the suspension member comprises at least one portion comprising at least one of the following: a flexible mesh, a cloth, a fabric, an elastic zone, a rigid or semi-rigid portion,
- the suspension member comprises a rear end connected preferably rigidly to the rear part of the flexible bag, a front portion connected preferably rigidly to the front part of the flexible bag,
- the suspension member comprises lateral ends connected preferably rigidly to the respective lateral portions of the flexible bag,
- the suspension member comprises, from the rear towards the front of the hood, a rear portion comprising at least one of the following: a flexible mesh, a cloth, a fabric, an elastic zone and a front first portion comprising at least one of the following: a rigid or semi-rigid portion,
- the said rear portion is connected to the rear part of the flexible bag and is intended to rest on the rear part of the top of the head of the user of the hood,
- the said rear portion is connected to the lower rear part of the flexible bag,
- the hood comprises a second front portion situated in front of the first front portion and comprising a rigid or semi-rigid component forming a helmet visor, one end of which is connected to the flexible bag above the window,
- the oxygen-enriched gas source comprises at least one tubular oxygen reservoir of pressurized oxygen,
- the oxygen-enriched gas source comprises at least one tubular oxygen reservoir of pressurized oxygen and an element that absorbs carbon dioxide exhaled by a user into the flexible bag,
- the carbon dioxide absorbing element comprises a cartridge for filtering the gas exhaled by the user into the flexible bag, the filter cartridge comprising an inlet communicating with the interior volume of the flexible bag and a filtered-air outlet opening into the interior volume of the flexible bag, the base of the flexible bag comprises a flexible diaphragm or a fluidtight collar intended to fit around the neck of a user, the outlet orifice of the tubular oxygen reservoir and the filtered-air outlet of the filter cartridge are arranged relative to one another in such a way as to form a venturi device, the oxygen-enriched gas source is secured to the base of the flexible bag preferably predominantly in the rear half of the hood, the oxygen-enriched gas source is secured to the suspension member, notably in the rear and lower part of the said suspension member, namely level with the lower and rear part of the flexible bag, the enriched-gas source is attached to a lower end of the flexible bag and has a mass for example of between 400 and 900 g.

The invention may also relate to any alternative device or method comprising any combination of the features hereinabove or hereinbelow.

Other specifics and advantages will become apparent from reading the following description given with reference to the figures in which:

DETAILED DESCRIPTION OF THE INVENTION

Figure 1:
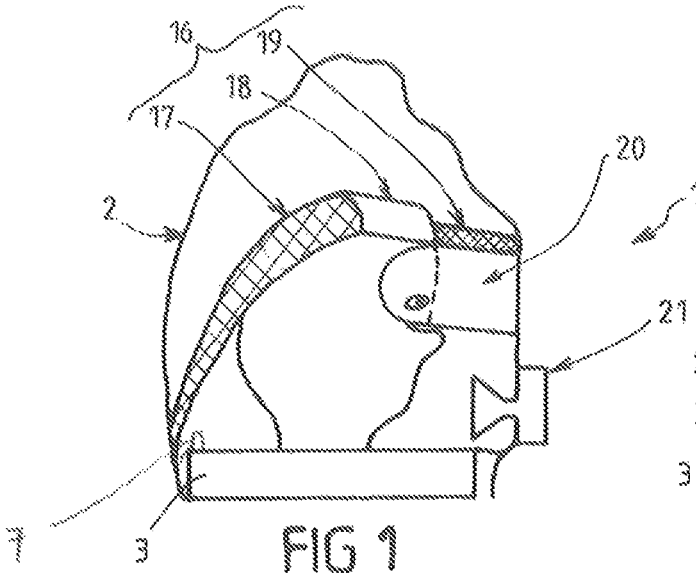
FIG. 1 depicts a schematic side view showing some hidden detail, illustrating the structure of another possible embodiment of a hood according to the invention.

FIG. 1 schematically depicts a full hood respirator 1 comprising a fluidtight flexible bag 2 equipped with a transparent window 20 intended to be slipped over the head of a user.

The fluidtight flexible bag 2 is made for example of a fire retardant textile that is fluidtight or made to be fluidtight, for example of the type marketed under the Nomex® brand and coated with a fluidtight and fire retardant coating.

Figure 3:
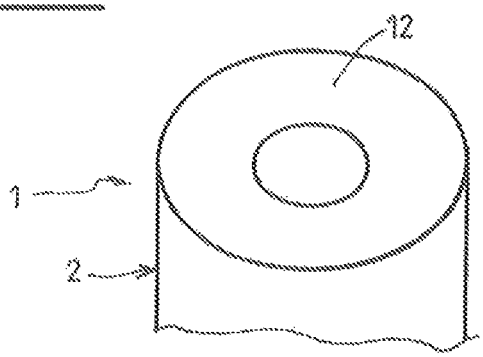
FIG. 3 is a view from beneath of a detail of the hood of FIGS. 1 and 2.

This bag 2 is intended to be slipped over the head of the user to isolate the head of the user from the external surroundings and incorporate the functionalities described hereinafter. In order to seal around the neck of the user and as described in FIG. 3, the base of the flexible bag 2 may comprise a flexible diaphragm or a fluidtight collar 12 intended to be fitted around the neck of a user. For example, this bottom collar 12 comprises a sheet of plastic (for example a polymer, notably a self-extinguishing polymer such as neoprene) that is pierced in order to allow the user's head to pass through elastically then tighten around his neck afterwards. The lower orifice for the head may be adapted to suit any neck circumference of between 28 and 42 cm for example.

The flexible bag 2 preferably delimits a volume of around twenty litres (plus or minus five litres) around the head of the user and this may form a buffer volume of breathable gas that is sufficient to absorb spikes in the user's breathing. This inflated volume also makes it possible to absorb any mismatch between the decreasing output of an oxygen source 3 which delivers gas into the flexible bag 2 and the relatively constant oxygen requirements of the user.

For preference, the flexible bag 2 is equipped on its front face with a curved visor with an anti-fog treatment on its interior face and an anti-scratch treatment on its exterior face and forming a viewing window 20 for the user.

Figure 2:
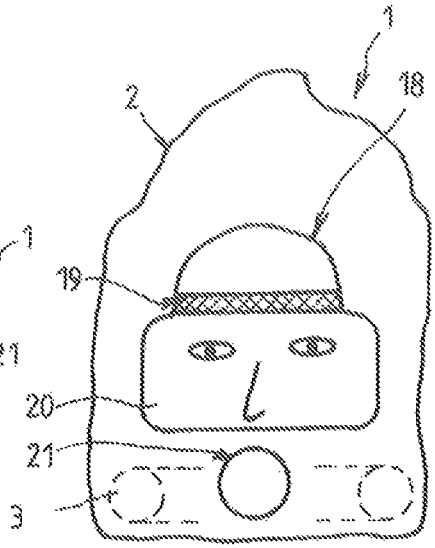
FIG. 2 is a schematic and partial front view illustrating the hood of FIG. 1.

As may be seen in FIGS. 1 and 2, the flexible bag 2 may also be provided with a phonic member 21 to facilitate direct communication or communication via an interphone or through a megaphone.

The hood 1 comprises a source 3 of oxygen-enriched gas comprising an outlet orifice 7 opening into the internal volume of the bag 2, preferably in the rear part of the hood 1.

The oxygen reservoir or reservoirs 3 for example have a volume of between 0.20 and 0.4 litres and store gas at a pressure of between for example 150 and 200 bar. The calibrated outlet orifice 7 for example has a diameter of between 0.04 and 0.15 mm to release for example between twenty and sixty litres of oxygen over fifteen minutes. Each reservoir 3 may be made of a tube made of stainless steel or some other material having a diameter of, for example, between 30 and 50 mm.

For example, the oxygen-enriched gas source 3 is connected to the lower part (base) of the flexible bag 2 and is positioned around the user's neck.

The gas source 3 may comprise one or more pressurized-oxygen reservoirs, for example one or more curved tubular reservoirs associated where applicable with a filter cartridge intended to absorb the carbon dioxide exhaled by the user. The filter cartridge for example comprises an inlet communicating with the interior volume of the flexible bag 2 (preferably at the front of the hood 1) and a filtered-air outlet opening into the interior volume of the flexible bag 2 (preferably at the rear part of the hood).

For preference, the filter cartridge uses soda lime in granular form to capture the carbon dioxide. Of course any other suitable filtration system may be contemplated. For example, the filter cartridge may also use lithium hydroxide. The filtration product may be stored in the cartridge in the form of granules, sheets with canals or porous mats for example.

In general, the system that captures the carbon dioxide may be of the passive type (the interior of the breathable volume being lined with a compound that absorbs $CO_2$) or active (where the gas that is to be purified is captured and channelled through the filter element).

The reaction for fixing the carbon dioxide is generally an exothermic reaction. That allows the relatively warm gases coming from the filter cartridge to mix with the relatively cooler oxygen leaving the reservoir 3. That means that a gas temperature that is very acceptable to the user can be maintained.

For preference also, the outlet orifice of the tubular oxygen reservoir and the filtered-air outlet 6 of the filter cartridge may be arranged relative to one another (particularly concentrically and coaxially) so as to form a venturi device.

This venturi device thus makes it possible to use the energy of expansion of the gas supplied by the pressurized reservoir 3 to create a recirculation stream through the filter cartridge (soda lime or lithium hydroxide). The oxygen is supplied by the oxygen reservoir 3 to the venturi which then generates a suction through the filter cartridge. The oxygen-enriched breathable mixture is delivered to the flexible bag 2.

For preference, the venturi has an entrainment ratio (aspirated flow rate/injected flow rate) of between 10 and 20 over the range of injected flow rates of 1 to 5 litres per minute for example.

This carbon dioxide capture system is thus independent of the breathing of the user. In addition, during the first fifteen minutes of use, the venturi blows for example between thirty and seventy litres of gas per minute. That makes a noise (blowing) audible to the user. That informs him that the equipment is working correctly.

This solution of the active filtration of the carbon dioxide produced by the user may be supplemented (or even replaced) by a passive filtration solution such as: lining the inside of the breathable volume with a compound which absorbs carbon dioxide or positioning one or more composite panels that absorb carbon dioxide at the key points (for example near the user's mouth).

According to one advantageous feature, the hood 1 comprises an internal structure as described hereinbelow.

Thus, the hood 1 may comprise, inside the flexible bag 2, a flexible suspension member 16 such as a cap or hat. This suspension member 16 is fixed to the flexible bag 2 and forms an internal hat or cap having a surface area smaller than the surface area of the outer bag 2. At least part of the border of the suspension member 16 is connected (bonded, stitched or the like) to the flexible bag 2, preferably a set distance from the upper end of the flexible bag 2. In this way, when the user slips the hood 1 on, this suspension member 16 rests on the top of the head of the user at a height somewhere between the base and the top of the hood 1 (cf. FIG. 1). What that means is, notably when the hood 1 is under pressure (oxygen is injected into the internal volume of the flexible bag 2), the hood 1 rests on (is suspended from) this suspension member 16 on the top of the head of the user.

That allows the weight of the hood 1 to be distributed over the head of the user and also means that the gas source 3, 4 (reservoir(s) filter cartridge, etc.) is not made to rest on the user's shoulders.

In this way, the hood 1 may move with the head of the user, the window 20 notably always remaining positioned in front of the user's eyes.

In addition, this structure keeps the viewing window 20 vertical with respect to the top of the user's head. The hood 1 thus does not need to have a tightening buckle and/or a strap that has to be adjusted in order to maintain a good fit, because there is very little spread in the morphology of the top of the head of potential users. The structure of the hood 1 is thus universal and does indeed fit a large number of different users.

In addition, this structure allows the outer bag 2 to inflate in order to form enough of a buffer volume without "floating" and moving around excessively around the user's head.

The suspension member 16 preferably comprises at least one portion 17 comprising at least one of the following: a flexible mesh, a cloth, a fabric, an elastic zone, a rigid zone, a semi-rigid zone.

In the example of FIGS. 1 and 2, the suspension member 16 comprises, from the rear of the hood 1 towards the front: a rear portion 17 comprising a flexible mesh, a front first portion 18 comprising a rigid or semi-rigid component and a rigid or semi-rigid second component 19 forming a helmet visor.

The rear portion 17 is connected to the rear part of the flexible bag, preferably at the lower base thereof. The lower rear end of the flexible member 16 may notably be connected to a gas source 3.

For preference, the gas source is distributed around the neck of the user predominantly in the rear part of the head and neck (because for example the front end of the hood or front half does not receive a gas source portion).

For example, the gas source has the overall shape of a U or a C and the opening of the U or of the C is situated in the front part of the hood (for example under the user's chin or lower jaw) while the base of the U or C is situated in the rear part of the hood (for example behind the nape of the neck of the user). The end of the second front portion 19 (helmet visor) is itself connected to the front end of the flexible bag, preferably above the viewing window 20.

This allows the transparent window 20 to be held a set distance away from the user's face (cf. FIG. 1). That makes the equipment easier to use with spectacles and improves user comfort, even for users with large noses.

For preference, and as described hereinafter with reference to FIGS. 4 and 5, the suspension member 16 is also attached laterally to the flexible bag 2 (on each side of the user's head). The rear portion 17, preferably made up of a flexible or even elastic mesh essentially rests on the rear half of the user's head and allows easy fit on female users wearing their hair in a bun or wearing hair slides (female cabin crew for example). This allows the hood 1 to fit and be positioned correctly on any type of user by distributing the centre of gravity of the hood 1 for greatest user comfort.

Of course, the suspension member 16 could be formed of a single flexible or semi-rigid portion.

Figure 4:
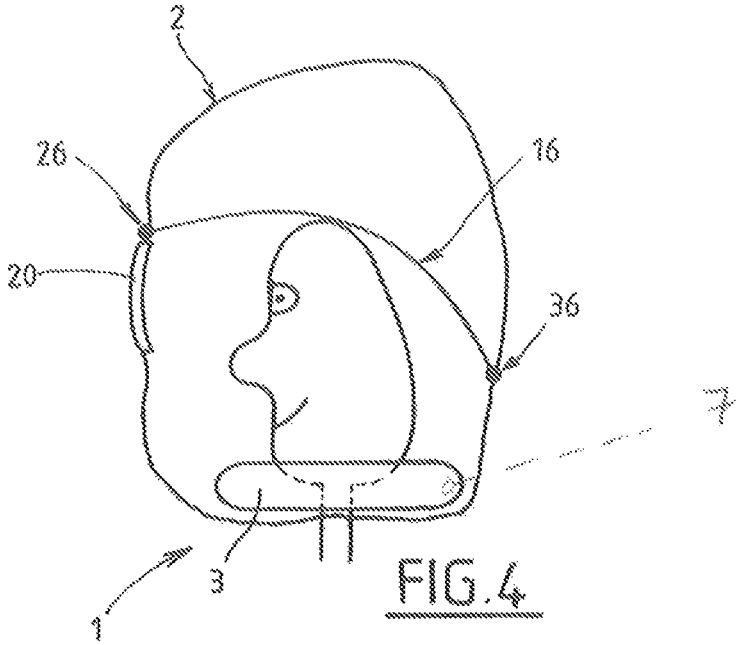
FIG. 4 depicts a schematic side view showing some hidden detail, illustrating the structure of another possible embodiment of a hood according to the invention.
Figure 5:
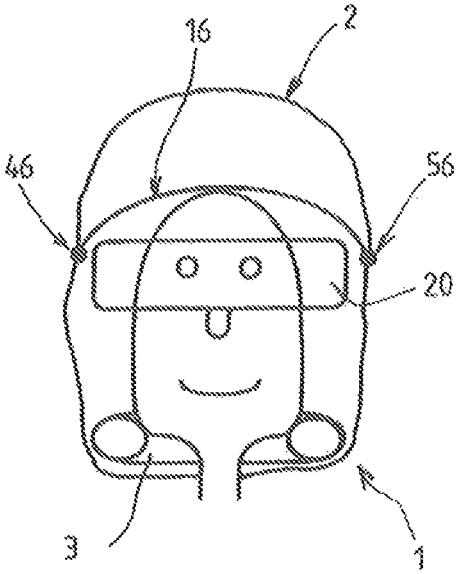
FIG. 5 is a schematic and partial front view illustrating the hood of FIG. 4.

FIGS. 4 and 5 illustrate an example of points at which the suspension member 16 is fixed to the flexible bag 2. For preference, the suspension member 16 is fixed to the flexible bag at the front, rear and lateral parts. For example, the suspension member 16 comprises four points of attachment to the flexible bag 2:

- a front fixing point 26 (preferably above the viewing window 20),
- a rear fixing point 36 (preferably at a height below the front fixing point, cf. FIG. 4),
- two lateral fixing points 46, 56 respectively situated one on each side of the space for the user's head (for example at the height of the viewing window 20).

Of course, as an alternative, the suspension member 16 could be fixed (stitched, bonded or the like) around its entire circumference to the flexible bag 2.

The suspension member 16 allows the hood 1 to be suspended and allows the centre of gravity of the hood to be re-centred with respect to the head of the user by fitting any type of hair style. This suspension system allows the function of holding the hood in place to be disassociated from the function of forming a buffer volume. In this way, the hood 1 may constitute an adequate buffer volume while the at the same time being correctly positioned and following head movements.

Thus, while being of simple and inexpensive structure, the hood 1 according to the invention offers numerous advantages over the prior art.

In particular, the hood 1 offers better ergonomics, displaying the possibility of having a large volume of gas around the user's head. Its structure, donning and wearing limit the risks of error, discomfort and the feeling of confinement. The hood has a universal structure which fits a broad spread of morphologies (sizes, spectacles, hair styles, etc.).

In addition, the relative arrangement of the gas source and of the suspension member allows an advantageous distribution of the weight of the hood on the head of the user and prevents the gas source from resting on the user's shoulders.

The gas source has a tendency to pull the flexible bag backwards toward the nape of the user's neck. The suspension member balances and compensates for this effect. The cap may thus press essentially on the forehead or the top of the forehead of the user.

The size needed is not increased and is even reduced in the case of the folding structure.

In the above example, the internal suspension structure has been described in a hood equipped with a gas source comprising a pressurised oxygen reservoir. Of course, this internal structure (suspension member 16) can be used for any other type of hood, notably one using a gas source that comprises a chemical oxygen generator.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising". "Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A full hood respirator comprising: a fluidtight flexible bag intended to be slipped over the head of a user, the fluidtight flexible bag being equipped with a transparent window disposed at a front of the fluidtight flexible bag and comprising, in a lower part of the fluidtight flexible bag, a source of oxygen-enriched gas connected to an outlet orifice opening into an internal volume of the fluidtight flexible bag, the source of oxygen-enriched gas being secured to a base of the fluidtight flexible bag; and a flexible suspension member arranged inside the fluidtight flexible bag that comprises, from a rear of the flexible suspension member to a front of the flexible suspension member, a rear portion comprising a flexible mesh, a rigid or semi-rigid first front portion connected to the rear portion, and a rigid or semi-rigid second front portion connected to the first front portion, the suspension member forming a hat or cap, having a surface area smaller than the surface area of the outer fluidtight flexible bag, the rigid or semi-rigid first and second front portions forming a helmet visor, the rear portion also being connected to a lower base rear part of the fluidtight flexible bag, the first front portion being connected to lateral portions of the fluidtight flexible bag, the second front portion being connected to a front part of the fluidtight flexible bag above the transparent window, the suspension member being adapted and configured such that, when the hood is in use position, to rest on the top of the head of the user at a height somewhere between the base and the top of the hood, the rear portion extending between the first front portion and the lower base rear part of the fluidtight flexible bag and being adapted and configured to rest on and fit over a hair bun at a rear half of a top of the user's head.

2. The hood of claim 1, wherein the oxygen-enriched gas source comprises at least one tubular oxygen reservoir of pressurized oxygen.

3. The hood of claim 1, wherein the base of the fluidtight flexible bag comprises a flexible diaphragm or a fluidtight collar intended to fit around a neck of the user.

* * * * *